US006611186B2

(12) United States Patent
Hanson et al.

(10) Patent No.: US 6,611,186 B2
(45) Date of Patent: Aug. 26, 2003

(54) SOLENOID HAVING AN ELASTOMERIC RETAINING DEVICE AND METHOD OF MANUFACTURING SAME WITHOUT POTTING

(75) Inventors: Kent R. Hanson, Loveland, CO (US); Jon S. Pointer, Fort Collins, CO (US); Henri A. Siedow, Fort Collins, CO (US); Allan W. Larson, Fort Collins, CO (US); Jeffrey E. McBride, Pierce, CO (US)

(73) Assignee: Woodward Governor Company, Fort Collins, CO (US)

( * ) Notice: Subject to any disclaimer, the term of this patent is extended or adjusted under 35 U.S.C. 154(b) by 0 days.

(21) Appl. No.: 09/793,150

(22) Filed: Feb. 26, 2001

(65) Prior Publication Data

US 2002/0118085 A1 Aug. 29, 2002

(51) Int. Cl.[7] ..... H01F 7/08
(52) U.S. Cl. ..... 335/220; 335/257; 335/281
(58) Field of Search ..... 335/220, 248–9, 335/250, 260–2, 277–8, 256–7, 273, 278, 281, 282; 251/129.01–129.22; 123/90.1, 90.49; 336/96, 90

(56) References Cited

U.S. PATENT DOCUMENTS 3,669,142 A * 6/1972 Gerbic ..... 251/129.15
5,339,063 A * 8/1994 Pham ..... 335/260
5,464,041 A * 11/1995 Reinicke ..... 251/129.15
5,734,311 A * 3/1998 Murata ..... 336/96
6,392,519 B1 * 5/2002 Ronning ..... 336/90

* cited by examiner

*Primary Examiner*—Lincoln Donovan
(74) *Attorney, Agent, or Firm*—Leydig, Voit & Mayer, Ltd.

(57) ABSTRACT

A electrical solenoid suitable for fluid controls applications with an elastomeric retaining device of an elastomeric material arranged between the housing and the lamination stack. The elastomeric retaining device eliminates the need for potting compound and the associated steps of filling the housing with potting and curing the potting compound. The solenoid has a wire coil wound about the lamination stack in which the wire coil has an electrical connection extending through the housing for electrical communication with an external electrical control. The end of the lamination stack projects out of the housing slightly after manufacturing and assembly. When the solenoid is mounted, the elastomeric retaining device biases the lamination stack against the mounting surface. The wire coil is pre-assembled in a wire coil assembly comprising a bobbin, a wire coil wound about the bobbin and a plastic overmold encapsulating the wire coil and bonded to the bobbin.

30 Claims, 7 Drawing Sheets

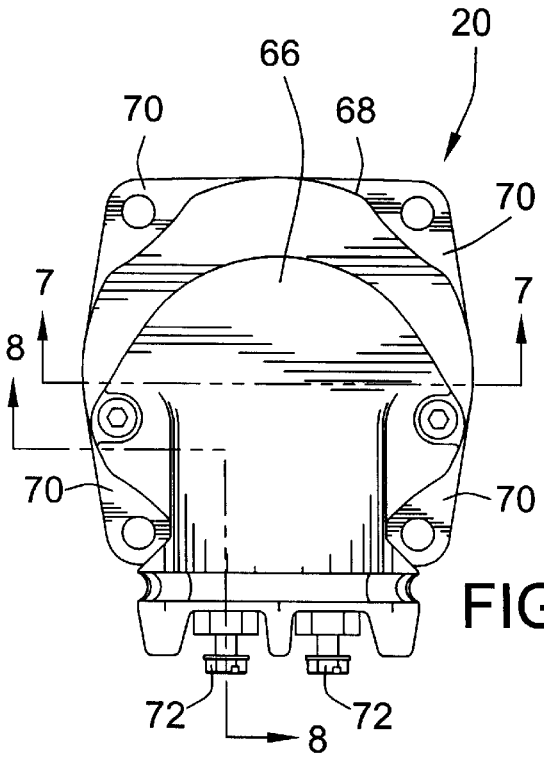
FIG. 2
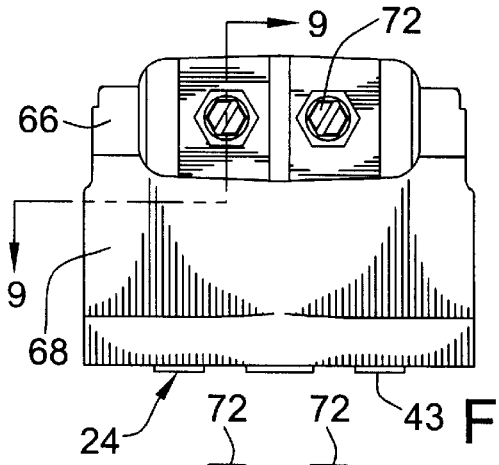
FIG. 3
FIG. 5
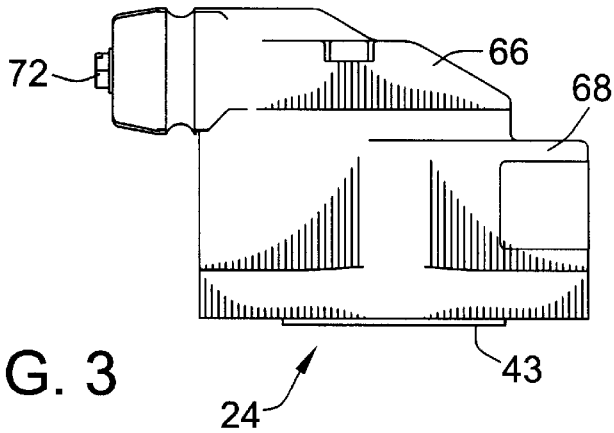
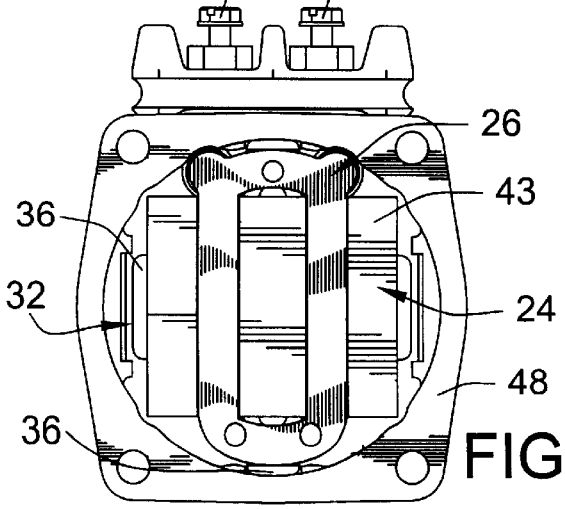
FIG. 4

SOLENOID HAVING AN ELASTOMERIC RETAINING DEVICE AND METHOD OF MANUFACTURING SAME WITHOUT POTTING

FIELD OF THE INVENTION

The present invention relates generally to electrical solenoids, and more particularly to retaining apparatus of solenoids and methods of manufacturing solenoids.

BACKGROUND OF THE INVENTION

Solenoids are widely used in the electromechanical and fluid controls industries, such as in engines and turbines, to switch a wide variety of control apparatus such as valves, drives, flow control devices, switches and the like between two states (typically either "on" and "off" states or "open" and "closed" states). Solenoids typically comprise a lamination stack and a wire coil wound about the lamination stack. The lamination stack and wire coil are housed and supported inside a solenoid housing that in turn can be mounted to the control apparatus.

Heretofore, the method of assembling and mounting the lamination stack and wire coil into a housing has been by potting the lamination stack and wire coil into the housing with a potting compound. According to this prior method of assembly, the lamination stack and wire coil are arranged in a fixed position inside the housing with leads of the wire coil connected to terminals on the housing. Then, potting compound (which is typically a relatively viscous liquid) is filled into all of voids between the housing, the lamination stack and wire coil. Thereafter, the potting compound is cured with high temperature baking over a predetermined time which solidifies the potting compound into a rigid solid mass and fixes the lamination stack and wire coil in position. Thereafter, the exposed end of the lamination stack and/or housing end are machine ground with a grinder to be coplanar with each other so that the solenoid seats in flat mating contact when mounted to fluid control devices or other such apparatus.

As will be appreciated by those of skill in the art, commercial production of solenoids using the potting method requires high volume production to justify all of the set up, tooling and fixture expenses. Minor changes to an existing solenoid design to meet different customer or application requirements are costly. Heretofore, there has been a desire for a lower volume or "medium volume" production solenoids in the marketplace.

Furthermore, as will be more fully appreciated by the present invention, the extra step of grinding the end of the lamination stack and/or housing end has been found by the inventors of the present invention to be inefficient. The time and heat required for potting and curing the potting compound have also been found by the inventors to be inefficient. Furthermore, cured potting compound can shrink or crack over time which can limit solenoid life.

SUMMARY OF THE INVENTION

According to one aspect of the invention, it is an objective of the present invention to provide a less expensive method for commercially manufacturing and assembling a solenoid in medium volume production for the fluid controls industries or other industries where such solenoids are utilized.

According to a different aspect of the invention, it is another objective of the present invention to provide a solenoid that avoids the potential drawbacks associated with potting compound such as inefficiencies associated with potting steps and shrinkage of cured potting material over time.

It is another objective of the present invention to provide a method of manufacturing and assembling a solenoid that may avoid the step of grinding the final lamination stack and housing assembly.

It is a further object of the present invention to provide a solenoid capable of being adequately sealed for such applications that require sealing, while achieving any or all of the above objectives.

In accordance with the foregoing objectives and/or other such objectives, the present invention is directed toward an electrical solenoid suitable for fluid controls applications with a novel method and apparatus for retaining the lamination stack in a solenoid housing. Accordingly, an elastomeric retaining device of an elastomeric material is arranged between the housing and the lamination stack to perform the retaining function. An advantage of the elastomeric retaining device is that the need for potting compound and the steps of filling the housing with potting and curing the potting compound can be eliminated. As is the case in any solenoid, a wire coil is wound about the lamination stack in which the wire coil has an electrical connection extending through the housing for electrical communication with an external electrical control. As will be pointed out further below, however, there are also novel and beneficial aspects of the wire coil assembly of the disclosed embodiment.

It is an aspect of the present invention that the end of the lamination stack projects out of the housing slightly after manufacturing and assembly operations. When the solenoid is mounted, the end of the lamination stack retracts to be coplanar with the mounting surface of the housing causing the elastomeric retaining device to compress, and the elastomeric retaining device biases the lamination stack against the mounting surface for axial retention.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings:

FIGS. 2–5 are top, front, side and bottom views of the solenoid similar to that illustrated in FIG. 1.

Figure 1:
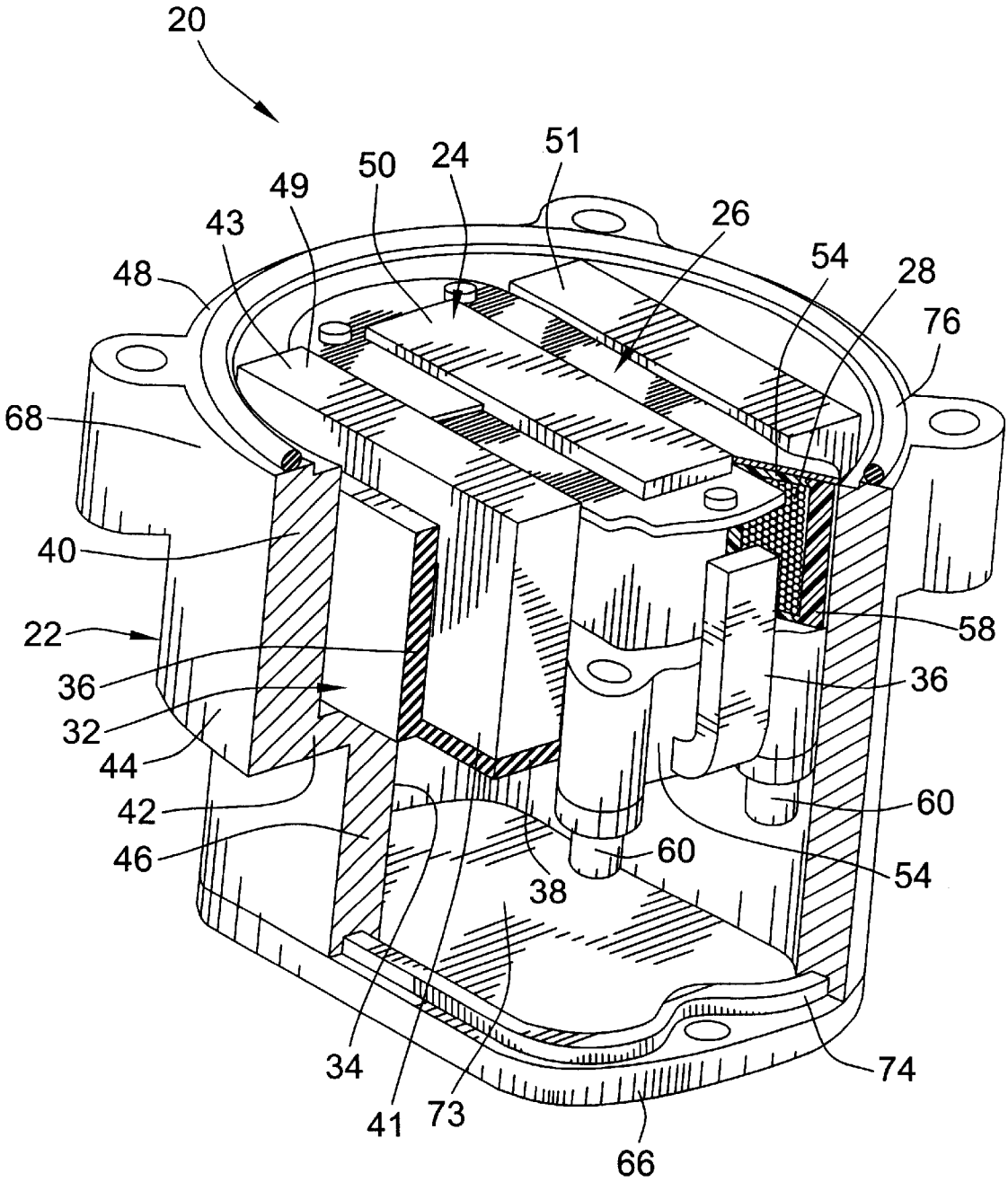
FIG. 1 is an isometric, partially cut-away view of an electrical solenoid according to a preferred embodiment of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENTS

For purposes of illustration, an embodiment of the present invention is illustrated as an electrical solenoid 20. The solenoid 20 comprises a rigid housing 22, a lamination stack 24, and a wire coil assembly 26. The wire coil assembly 26 contains a wire coil 28 which is arranged in a wound coil about the lamination stack 24 when the solenoid is assembled. The wire coil 28 can be energized to magnetize the lamination stack 24 and effect a magnetic force that in turn can be used to position associated fluid controls or other devices.

In accordance with the present invention, an elastomeric retaining device in the form of a pre-formed elastomeric retaining web 32 retains the lamination stack 24 inside the internal cavity 34 of the housing 22. The elastomeric retaining web 32 is a pre-formed device that may be inserted into the cavity 34 of the housing 22 prior to installing the lamination stack 24 into the housing 22. Alternatively, the retaining web 32 may also be arranged over the exterior of the lamination stack 24 and then the combination inserted into the housing 22. The retaining web 32 is comprised of a resilient, elastomeric material such as a flouro-elastomer such as AFLAS or other suitable rubber/elastomeric material such as silicon based elastomers possibly.

Figure 6:
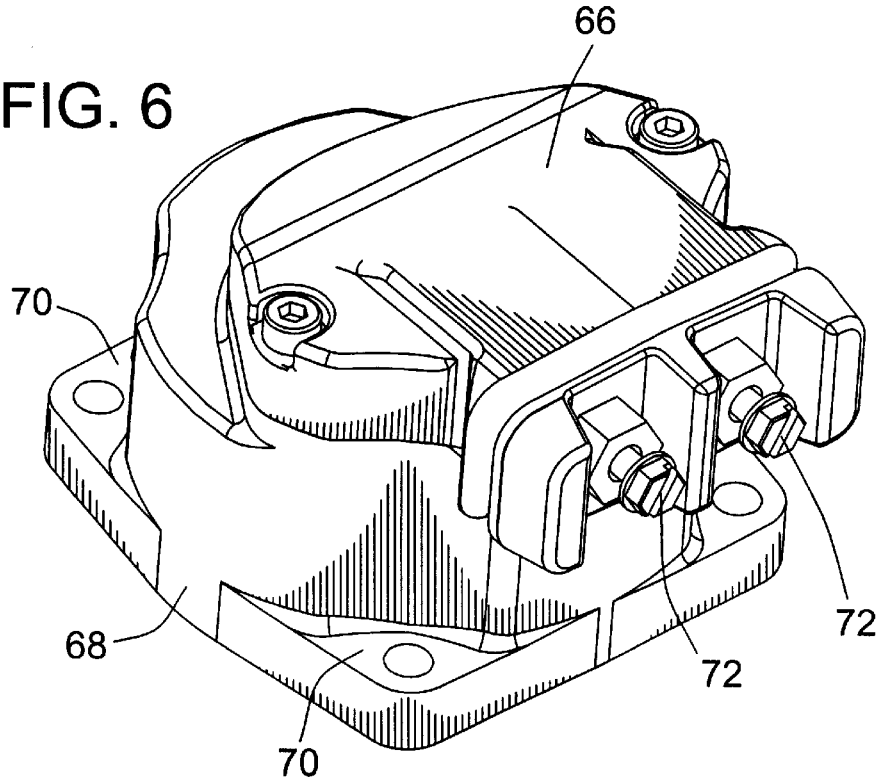
FIG. 6 is an isometric view of the solenoid illustrated in FIGS. 2–5.
Figure 12:
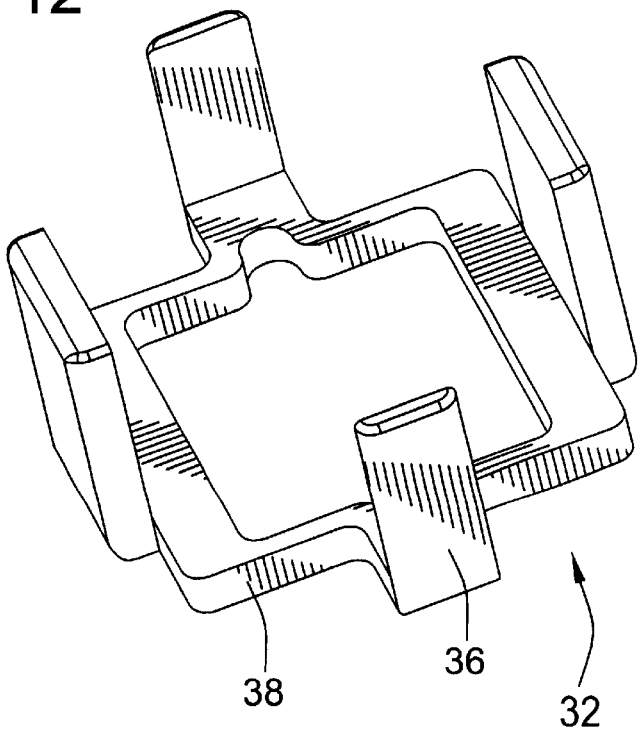
FIG. 12 is an isometric view of the retaining device used in the solenoid illustrated previously in FIGS. 1–9.

In the disclosed embodiment, the retaining web 32 comprises several sides 36 surrounding and engaging sides of the lamination stack 24 and wire coil assembly 26 (a continuous sidewall completely surrounding the lamination stack may also be used) for radial retention and a radially planar ring shaped flange portion 38 projecting radially inward from an end of the sides 36 for axial retention purposes. The sides 36 may be slightly angled in configuration as illustrated in FIG. 6 to facilitate easy insertion of the retaining web 32 and lamination stack 24 into the housing 22. The sides 36 are dimensioned and spaced to closely fit and provide an interference fit between the inner diameter of the larger diameter housing section 40 and the outer peripheral surface of the lamination stack 24 and wire coil assembly 26. This close dimensioning of the retaining web sides 36 and slight radial compression in the sides 36 ensure that the lamination stack 24 properly centers in the housing 22 and separates/cushions the lamination stack 24 from the housing 22.

Figure 7:
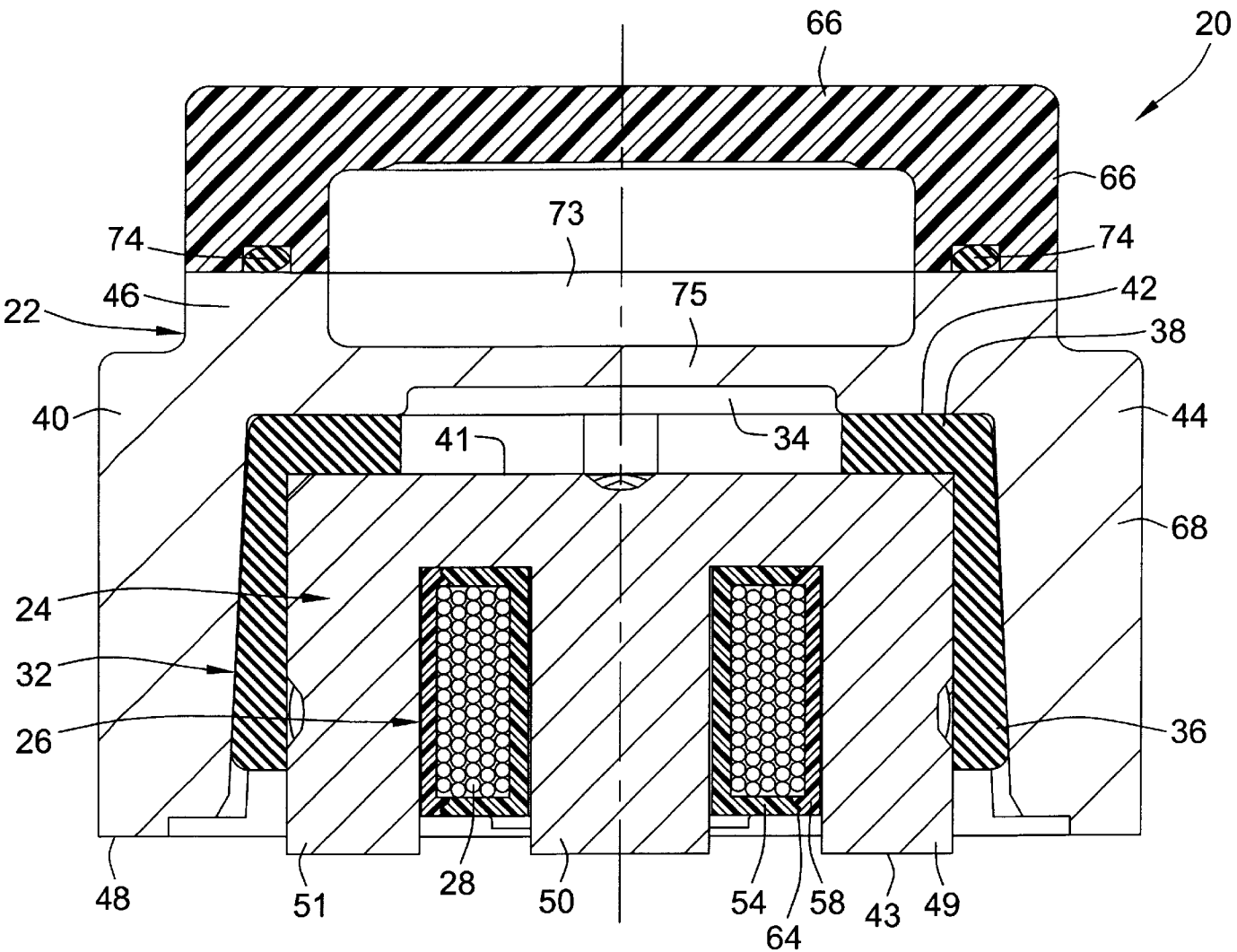
FIG. 7 is a cross-section of FIG. 2 taken about line 7—7.
Figure 13:
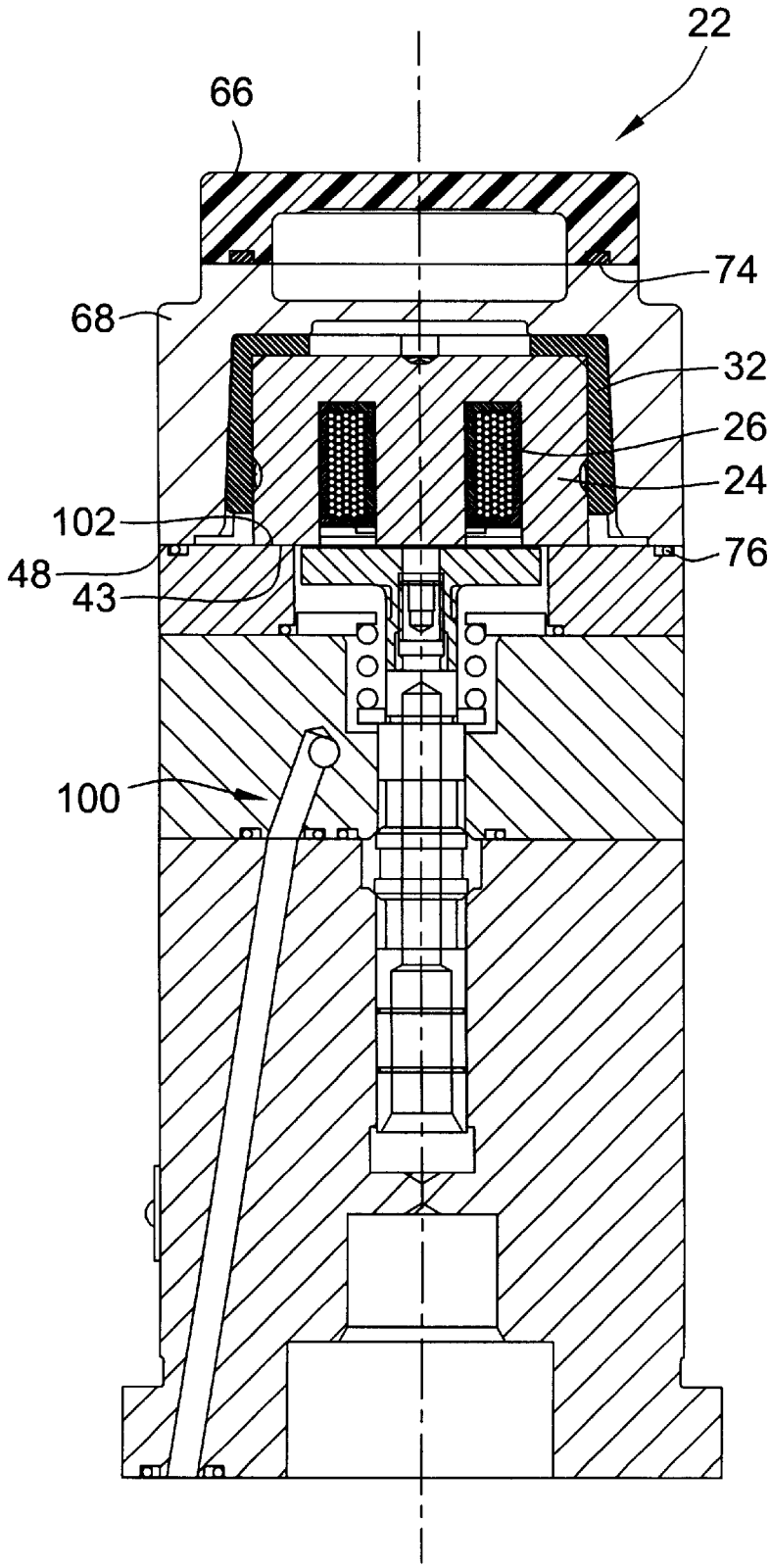
FIG. 13 is a cross-section of the solenoid illustrated in FIG. 7 in combination with one such example of a fluid control device, thus illustrating one of the many applications for the solenoid.

The flange portion 38 of the retaining web 32 is seated axially between one axial end 41 of the lamination stack 24 and an annular radially planar shoulder 42 defined at a corner 44 between the larger diameter section 40 of the housing 22 and a smaller diameter section 46 of the housing. The flange portion 38 is thick enough such that the other axial end 43 of the lamination stack projects axially beyond the radially planar annular end mating surface 48 of the housing 22 when assembled. However, the projecting axial end 43 of the lamination stack projects axially out of the housing relative to surface 49 at a distance less than the axial thickness of the flange portion 38 of the retaining web 32 (and preferably only between about 20 percent and 40 percent of the axial thickness of the retaining web). With this interrelationship between dimensions, the flange portion 38 of the retaining web 32 will compress until the projecting axial end 43 of the lamination stack 24 retracts to be coplanar with the end mating surface 48 of the housing 22 when the solenoid 20 is mounted in flat surface 48 to surface 102 mating contact a fluid control device 100 (See e.g. FIG. 11). Once the solenoid 20 is mounted, the compression in the retaining web 32 biases the lamination stack 24 to secure and fixes the lamination stack 24 relative to the housing 22. When properly mounted, the retaining web 32 exerts an axial retaining force of between 50 and 500 pounds depending on the size of the solenoid. The mounting axis and axial force axis are shown in FIGS. 7 and 13 as a center line.

Figure 8:
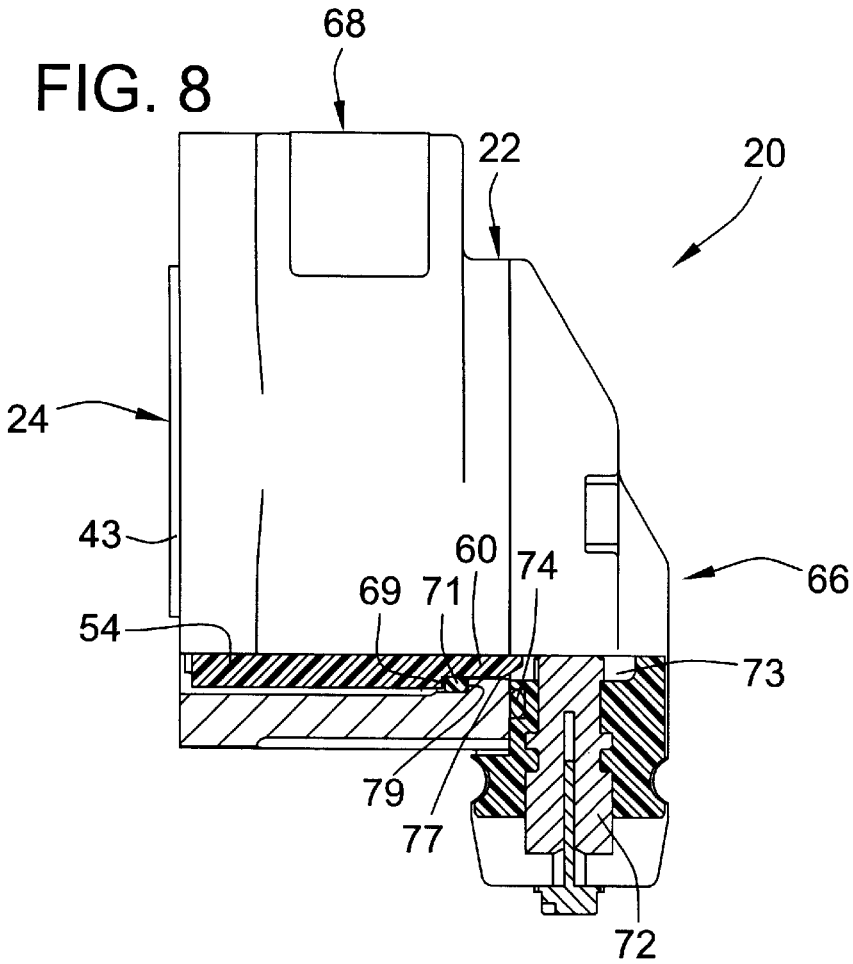
FIG. 8 is a cross-section of FIG. 2 taken about line 8—8.
Figure 9:
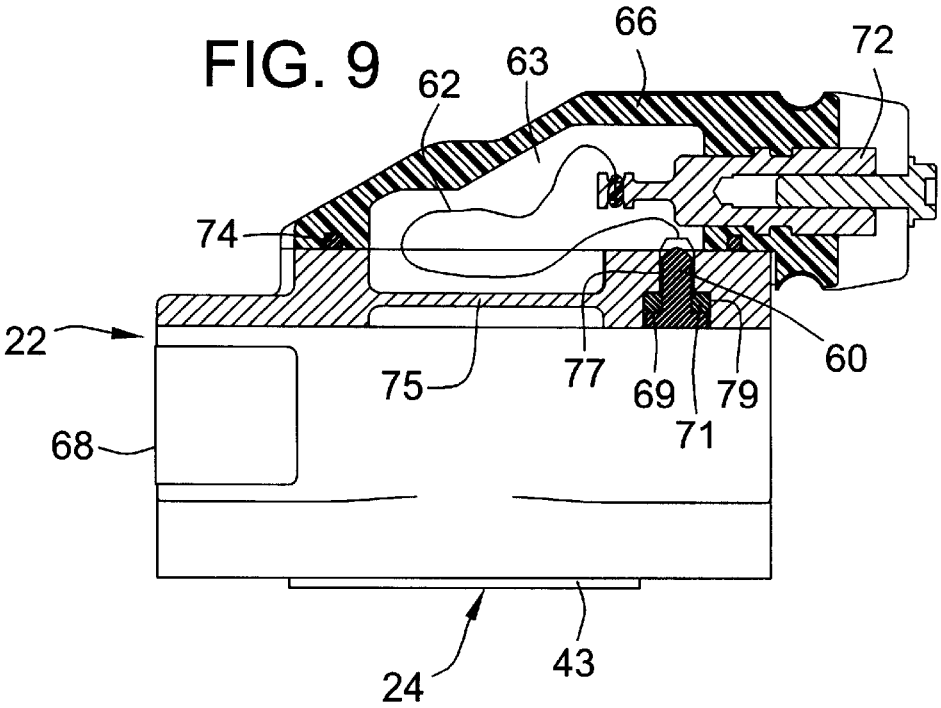
FIG. 9 is a cross-section of FIG. 3 taken about line 9—9.
Figure 10:
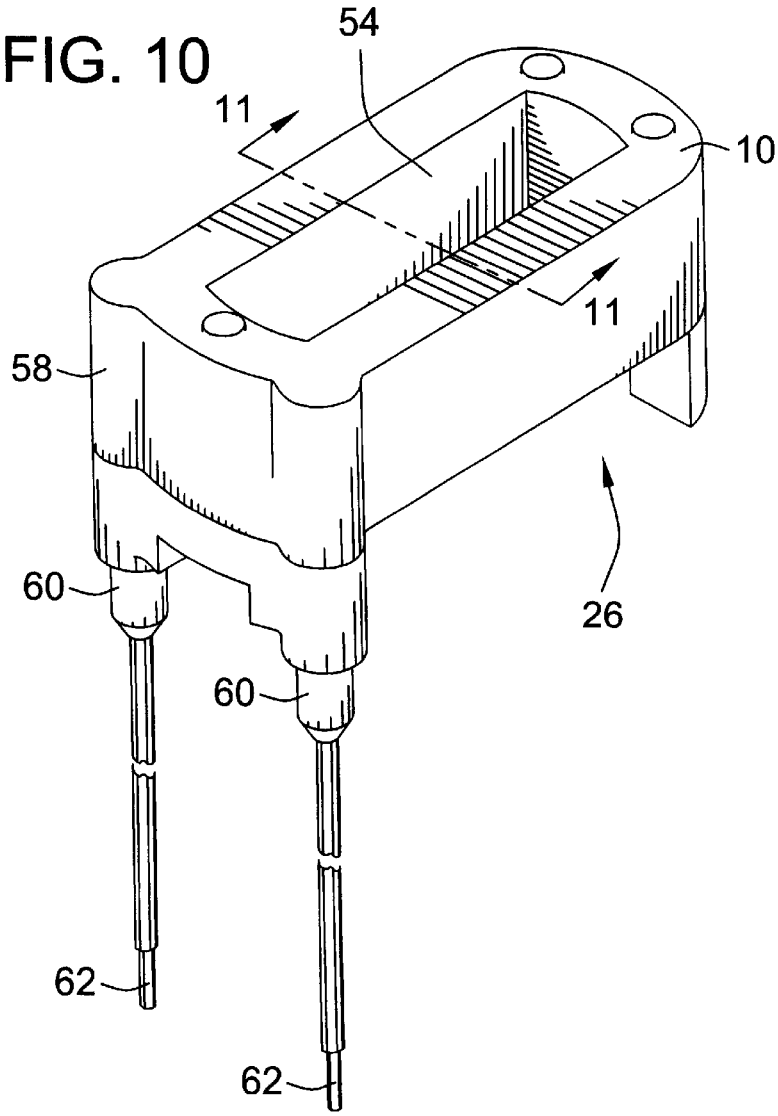
FIG. 10 is an isometric view of a wire coil assembly used in the solenoid illustrated in the previous drawings.

The wire coil assembly 26 also is novel in that it is a pre-assembled part as shown in FIGS. 9 and 10, that does not require the step of potting to seal the wires if the desired application requires such sealing. In the disclosed embodiment, the solenoid 20 has a three leg lamination stack 24 with the three legs indicated 49, 50, 51. The wire coil assembly 26 is sized to closely fit over the center leg 50 and fill the gaps or spaces between the intermediate leg 50 and outside legs 49, 51. In the disclosed embodiment, the wire coil assembly 26 comprises a wire coil 28 that is wound about a spool or bobbin 54 and then encapsulated in a thermoplastic overmold 58. The bobbin 54 is manufactured of a similar plastic material with a similar melting point which improves remelting and sealing at the heat weld interface 64 between the overmold 58 and the bobbin 54. The bobbin 54 has a pair of coil bosses 60 which support electrical leads 62 that are operatively connected to the wire coil 28. The bosses 60 have a reduced diameter tip with a formed shoulder 69 that supports resilient O-rings 71 (see FIGS. 8 and 9) that seal an air gap 73 containing exposed electrical leads from the external environment preventing gases from reaching the air gap 73 that may travel between the retaining device and housing. The tips of the coil bosses 60 extend through holes 77 in a partition web 75 extending across the top of the housing. The O-rings 71 seat against a formed counter-bore 79 in the partition web 75, and compress between the bosses 60 and seat of the counter-bore 79.

Figure 11:
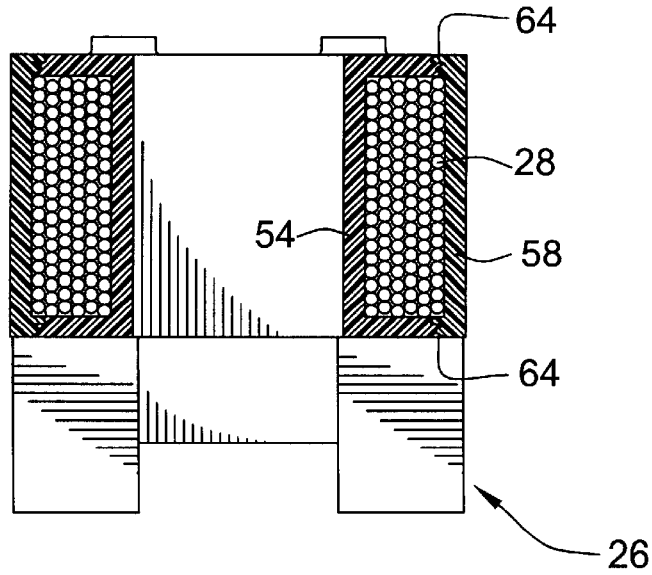
FIG. 11 is a cross-section of FIG. 10 taken about line 11—11.

In the disclosed embodiment, the housing 22 is a two piece assembly comprising a cover 66 fastened to a generally cylindrical mounting base 68 having an outer sidewall enclosing the wire coil assembly 26 and the lamination stack 24. Although in alternative embodiments of the instant invention the plastic coil overmold could provide for the top end termination, a two piece housing allows various different cover configurations to be used depending upon application and without the need to change the mounting base, the lamination stack, the elastomeric retaining device or the plastic overmold configuration for the wire coil assembly. The mounting base includes mounts in the form of bosses or flanges 70 to facilitate mounting to a fluid control device 100 (FIG. 11). The cover 66 may be a plastic injection molded part while the mounting base 68 is preferably molded metal material for proper support and mounting of the solenoid. The cover 66 has two electrical terminals 72 mounted therein which provide for electrical connection to an external electrical control (not shown). The terminals 72 are electrically connected to the wire leads 62 via soldering or other suitable electrical coupling. The excess wire from the wire leads 62 preferably reside in a sealed air gap 73 that exists between the cover 66 and the partition web 75 across the top of the housing. An o-ring 74 is arranged between the cover 66 and the mounting base 68 to provide a seal therebetween. An o-ring 76 may also be arranged along the mating surface 48 of the housing 22 to provide a seal between the fluid control device 100 and the solenoid 20 when mounted thereto.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A electrical solenoid, comprising:

a housing;

a lamination stack disposed in the housing;

a wire coil arranged about the lamination stack;

an elastomeric retaining device of an elastomeric material between the housing and the lamination stack; and wherein the lamination stack is movable relative to the housing through compression and expansion of the elastomeric retaining device.

2. The electrical solenoid of claim 1 wherein the lamination stack has an end projecting axially from the housing a distance of between 20 percent and 40 percent of an axial thickness of the elastomeric retaining device.

3. The electrical solenoid of claim 1 wherein the wire coil is part of a pre-assembled wire coil assembly having a bobbin upon which the wire coil is wound, the wire coil being substantially encapsulated in a plastic overmold.

4. The electrical solenoid of claim 3 wherein the housing is of a multiple piece assembly including a mounting base and a cover mounted to an end of the mounting base, the mounting base supporting the lamination stack and wire coil assembly, the cover having electrical terminals electrically connected to corresponding wire leads of the wire coil, the wire leads extending through the plastic overmold and being situated in an air gap defined between the cover and a partition wall extending across the housing, the wire leads extending through the partition wall in a sealed manner.

5. The electrical solenoid of claim 1 wherein the housing comprises a sidewall surrounding the lamination stack and wire coil, the sidewall terminating in a planar mating surface, wherein an end of the lamination stack projects axially outside beyond the plane of the planar mating surface, the end of the lamination stack aligning coplanar with the planar mating surface when an axial force is applied against the end of the lamination stack thereby compressing elastomeric retaining device.

6. A electrical solenoid, comprising:

a housing comprising a mounting base and a cover, the mounting base having a sidewall terminating in an annular planar mounting surface, the cover having electrical terminals for electrical communication with an external electrical control;

a lamination stack in the housing surrounded by the sidewall, the lamination stack having first and second ends;

a wire coil assembly arranged about the lamination stack, the wire coil assembly having electrical leads electrically connected to the electrical terminals of the housing;

a pre-formed elastomeric retaining device of an elastomeric material between the housing and the lamination stack for axial retention of the lamination stack;

wherein the first end of the lamination stack projects outside of the housing breaking the plane of the annular planar mounting surface, the first end of the lamination stack aligning coplanar with the planar mating surface when an axial force is applied against the end of the lamination stack thereby compressing elastomeric retaining web.

7. The electrical solenoid of claim 6 wherein the wire coil assembly comprises a wire wound on a bobbin, and a plastic overmold substantially encapsulating the wire, the plastic overmold being integral with the bobbin.

8. The electrical solenoid of claim 6 wherein the mounting base defines an annular seating surface for axially supporting the elastomeric retaining device, the elastomeric retaining device comprising a ring shaped flange portion seated on the annular seating surface and at least one side projecting axially toward the first end of lamination stack and at least partially surrounding the lamination stack.

9. The electrical solenoid of claim 8 wherein the first end of the lamination stack projects an axial distance relative to the plane of annular planar mounting surface that is between 20 percent and 40 percent of the axial thickness of the flange portion.

10. The electrical solenoid of claim 6 wherein the elastomeric retaining device applies a counteracting axial force of between about 50 pounds and about 500 pounds when the elastomeric retaining web is under compression with the end of the lamination stack coplanar with the planar mounting surface.

11. The electrical solenoid of claim 7 wherein the electrical leads are disposed in an air gap axially between the cover and the elastomeric retaining web.

12. The electrical solenoid of claim 6 wherein the lamination stack has three legs extending axially in spaced relation, the lamination stack being arranged about the intermediate leg of the three legs.

13. An electrical solenoid for controlling position of an apparatus, the apparatus having a mounting surface for supporting the electrical solenoid, comprising:

a housing including a generally cylindrical mounting base having mounts for facilitating fastening, and a cover enclosing a first end of the mounting base, the mounting base including an planar second end adapted to mate against the mounting surface;

electrical terminals mounted in the cover for electrical connection to an external electrical control;

a lamination stack having three legs including an intermediate leg between outer legs;

a wire coil assembly comprising a bobbin upon which a coil of wire is wound, a coil overmold substantially encapsulating the coil of wire, and electrical leads, the coil assembly arranged over the intermediate leg, the electrical leads being electrically connected to the electrical terminals;

a pre-formed elastomeric retaining web of an elastomeric material disposed axially between the lamination stack and the housing, the lamination stack having an end portion projecting past the second end of the housing; and wherein when the electrical solenoid is mounted to the fluid control apparatus with the second end in mating contact with the mounting surface the end portion of the lamination stack retracts placing the elastomeric retaining web in compression thereby biasing the lamination stack against the mounting surface.

14. The electrical solenoid of claim 13 wherein the mounting base includes a larger section proximate the second end and a smaller section the first end, the larger and smaller sections joined by a radial shoulder, the preformed elastomeric retaining web comprising a ring shaped flange portion seated on the radial shoulder and a plurality of sides projecting axially therefrom at least partially surrounding the lamination stack.

15. The electrical solenoid of claim 14 wherein the end portion of the lamination stack projects an axial distance relative to the plane of annular planar mounting surface that is between 20 percent and 40 percent of the axial thickness of the flange portion.

16. The electrical solenoid of claim 13 wherein the electrical leads are disposed in an air gap axially between the cover and a partition wall extending across the housing, the electrical leads extending through holes in the partition wall, the coil overmold including bosses encapsulating a portion of the wire leads, the bosses being inserted into the holes and compressing o-rings against the partition wall to seal the air gap.

17. The electrical solenoid of claim 16 further comprising a ring seal compressed between the cover and the mounting base.

18. The electrical solenoid of claim 17 further comprising an o-ring gasket carried on the planar annular second end of the housing for forming a seal against the mounting surface.

19. The electrical solenoid of claim 1 wherein the elastomeric ring applies a counteracting axial force of between about 50 pounds and about 500 pounds when the electrical solenoid is mounted to the mounting surface.

20. The electrical solenoid of claim 1 wherein the elastomeric retaining device includes a flange portion disposed axially between the housing and the lamination stack and at least one side portion extending axially from the flange portion radially between the housing and the lamination stack.

21. The electrical solenoid of claim 20 wherein the at least one side comprises four generally planar sides engaging different sides of the lamination stack and wire coil.

22. The electrical solenoid of claim 1 wherein the elastomeric retaining device is in direct contact with the lamination stack and the housing.

23. The electrical solenoid of claim 1 further comprising an outer seal on an end of the housing surrounding the lamination stack.

24. The electrical solenoid of claim 6 wherein the elastomeric retaining device includes a flange portion disposed axially between the housing and the lamination stack and at least one side portion extending axially from the flange portion radially between the housing and the lamination stack.

25. The electrical solenoid of claim 24 wherein the at least one side comprises four generally planar sides engaging different sides of the lamination stack and wire coil.

26. The electrical solenoid of claim 6 wherein the elastomeric retaining device is in direct contact with the lamination stack and the housing.

27. The electrical solenoid of claim 6 further comprising an outer seal on the annular planar mounting surface of the housing surrounding the lamination stack.

28. The electrical solenoid of claim 13 wherein the elastomeric retaining device includes a flange portion disposed axially between the housing and the lamination stack and at least one side portion extending axially from the flange portion radially between the housing and the lamination stack.

29. The electrical solenoid of claim 28 wherein the at least one side comprises four generally planar sides engaging different sides of the lamination stack and wire coil.

30. The electrical solenoid of claim 13 wherein the elastomeric retaining device is in direct contact with the lamination stack and the housing.

* * * * *